US010253715B2

(12) United States Patent
Oh

(10) Patent No.: US 10,253,715 B2
(45) Date of Patent: Apr. 9, 2019

(54) METHOD FOR CONTROLLING INJECTOR OF VEHICLE

(71) Applicants: Hyundai Motor Company, Seoul (KR); Kia Motors Corporation, Seoul (KR)

(72) Inventor: Young Kyu Oh, Gwacheon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/787,507

(22) Filed: Oct. 18, 2017

(65) Prior Publication Data

US 2018/0171924 A1 Jun. 21, 2018

(30) Foreign Application Priority Data

Dec. 15, 2016 (KR) ..... 10-2016-0171216

(51) Int. Cl.
*F02D 41/24* (2006.01)
*F02D 41/30* (2006.01)
*F02D 41/20* (2006.01)

(52) U.S. Cl.
CPC ..... *F02D 41/2467* (2013.01); *F02D 41/2474* (2013.01); *F02D 41/3094* (2013.01); *F02D 41/247* (2013.01); *F02D 2041/2055* (2013.01); *F02D 2041/2058* (2013.01); *F02D 2200/023* (2013.01); *F02D 2200/0602* (2013.01); *F02D 2200/0614* (2013.01); *F02D 2200/0618* (2013.01)

(58) Field of Classification Search
CPC .. F02D 41/24; F02D 41/2467; F02D 41/2447; F02D 41/3094
USPC ..... 701/102–105; 123/299, 300, 490, 647
See application file for complete search history.

(56) References Cited

U.S. PATENT DOCUMENTS 6,378,498 B2 * 4/2002 Kohketsu ..... F02D 41/221 123/198 D
9,624,883 B2 * 4/2017 Namuduri ..... F02M 51/0689
(Continued)

FOREIGN PATENT DOCUMENTS

JP 2003-254139 9/2003
JP 2012-211523 11/2012
(Continued)

*Primary Examiner* — John Kwon
*Assistant Examiner* — Johnny H Hoang
(74) *Attorney, Agent, or Firm* — Morgan, Lewis & Bockius LLP

(57) ABSTRACT

A method for controlling an injector of a vehicle may include: a step of determining, by a controller, a targeted opening time and a targeted closing time for at least one injector according to a current driving condition; a step of measuring, by the controller, an closing time of the injector controlled depending on the targeted closing time; and after the measuring step, a step of determining, by the controller, a deviation of the closing time with respect to the targeted closing time and determining a learning closing time obtained by reflecting the deviation to the targeted closing time to store a corresponding driving condition, in which in the determining step, when there is the learning closing time stored for the current driving condition, the targeted closing time is configured to be determined by reflecting the learning closing time.

10 Claims, 10 Drawing Sheets

(56) References Cited

U.S. PATENT DOCUMENTS

| | | | | |
|---|---|---|---|---|
| 2009/0070002 | A1* | 3/2009 | Ishikawa | F02B 15/00 701/103 |
| 2013/0325301 | A1* | 12/2013 | Gautier | F02D 41/2438 701/104 |
| 2015/0184626 | A1* | 7/2015 | Denk | F02D 41/2096 123/478 |
| 2016/0138511 | A1* | 5/2016 | Toyohara | F02D 41/20 123/478 |
| 2017/0022928 | A1* | 1/2017 | Jin | F02D 41/401 |
| 2017/0175666 | A1* | 6/2017 | Kim | F02D 41/1402 |
| 2017/0306877 | A1* | 10/2017 | Ahn | F02D 41/2467 |

FOREIGN PATENT DOCUMENTS

| | | |
|---|---|---|
| JP | 2014-234923 | 12/2014 |
| JP | 2016-098688 | 5/2016 |
| KR | 10-1998-086522 A | 12/1998 |

* cited by examiner

METHOD FOR CONTROLLING INJECTOR OF VEHICLE

CROSS-REFERENCE(S) TO RELATED APPLICATIONS

The present application claims priority to Korean Patent Application No. 10-2016-0171216, filed on Dec. 15, 2016, the entire contents of which is incorporated herein for all purposes by this reference.

BACKGROUND OF THE INVENTION

Field of the Invention

The present invention relates to a method for controlling an injector of a vehicle, and more particularly, to a method for controlling an injector for injecting fuel supplied to an engine.

Description of Related Art

An engine of a vehicle may be provided with an injector for injecting fuel. The injector may be provided in plural, and may be provided in various manners including directly injecting fuel into a combustion chamber, injecting fuel onto an intake passage, and the like.

Meanwhile, an fuel amount to be supplied to the combustion chamber varies according to a running condition of a vehicle. Therefore, when the supply of the fuel amount is not properly controlled, a misfire may occur and an ideal combustion is not performed, and harmful substances in emissions may be increased.

Therefore, it is important to precisely control the injector injecting the fuel in the vehicle, including improving fuel efficiency without reducing engine performance and suppressing an increase of harmful substances.

The information disclosed in this Background of the Invention section is only for enhancement of understanding of the general background of the invention and should not be taken as an acknowledgment or any form of suggestion that this information forms the prior art already known to a person skilled in the art.

BRIEF SUMMARY

Various aspects of the present invention are directed to providing an injector of a vehicle injecting fuel configured for precisely controlling an injection of fuel to effectively improve engine performance, improve fuel efficiency, and effectively reducing harmful substances.

According to an exemplary embodiment of the present invention, there is provided a method for controlling an injector of a vehicle, including: a step of determining, by a controller, a targeted opening time and a targeted closing time for at least one injector according to a current driving condition; a step of measuring, by the controller, an actual closing time of the injector controlled depending on the targeted closing time; and after the measuring step, a learning step of determining, by the controller, a deviation of the actual closing time with respect to the targeted closing time and determining a learning closing time obtained by reflecting the deviation to the targeted closing time to store the corresponding driving condition, in which in the determining step, when there is the learning closing time stored for the current driving condition, the targeted closing time is determined by reflecting the learning closing time.

In the determining step, the controller may determine the targeted opening time and the targeted closing time, including the currently required fuel amount and fuel pressure in the driving condition.

In the determining step, the fuel amount may correspond to a value corrected by reflecting an oil temperature.

In the determining step, the controller may determine the targeted closing time according to the driving condition and determine the targeted opening time by reflecting the targeted closing time.

In the determining step, the controller may determine the targeted opening time immediately before and after the targeted closing time, wherein the injection of the fuel by the injector is performed in multi stage.

The method may further include: a pulsation compensating step of compensating for, by the controller, the targeted closing time by considering the influence of pulsation according to the rotations-per-minute (RPM) of the engine after the determining step.

The method may further include: a step of synchronizing, by the controller, the targeted closing times between the plurality of injectors after the determining step.

In the measuring step, the voltage detecting device may measure the voltage value for the operation of the injector and the controller may receive the voltage value and determine the actual closing time.

The method may further include: a learning condition determining step of determining, by the controller, whether the driving condition corresponds to a predetermined learning area after the determining step, in which in the measuring step, the actual closing time may be measured when the driving condition corresponds to the learning area.

In the learning step, the controller may determine the learning closing time to which the actual closing time is reflected in the learning area under at least one specific driving condition, and set and store the learning closing time for an area in which the specific driving condition is ruled out from the learning area so the learning closing time has the continuity in response to the change in the driving condition and follows the learning closing time determined in the specific driving condition.

In the learning step, the controller may set and store the learning closing time stored in the learning area so that the learning closing time follows the targeted closing time for the boundary condition of the learning area while having the continuity in response to the change in the driving condition.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
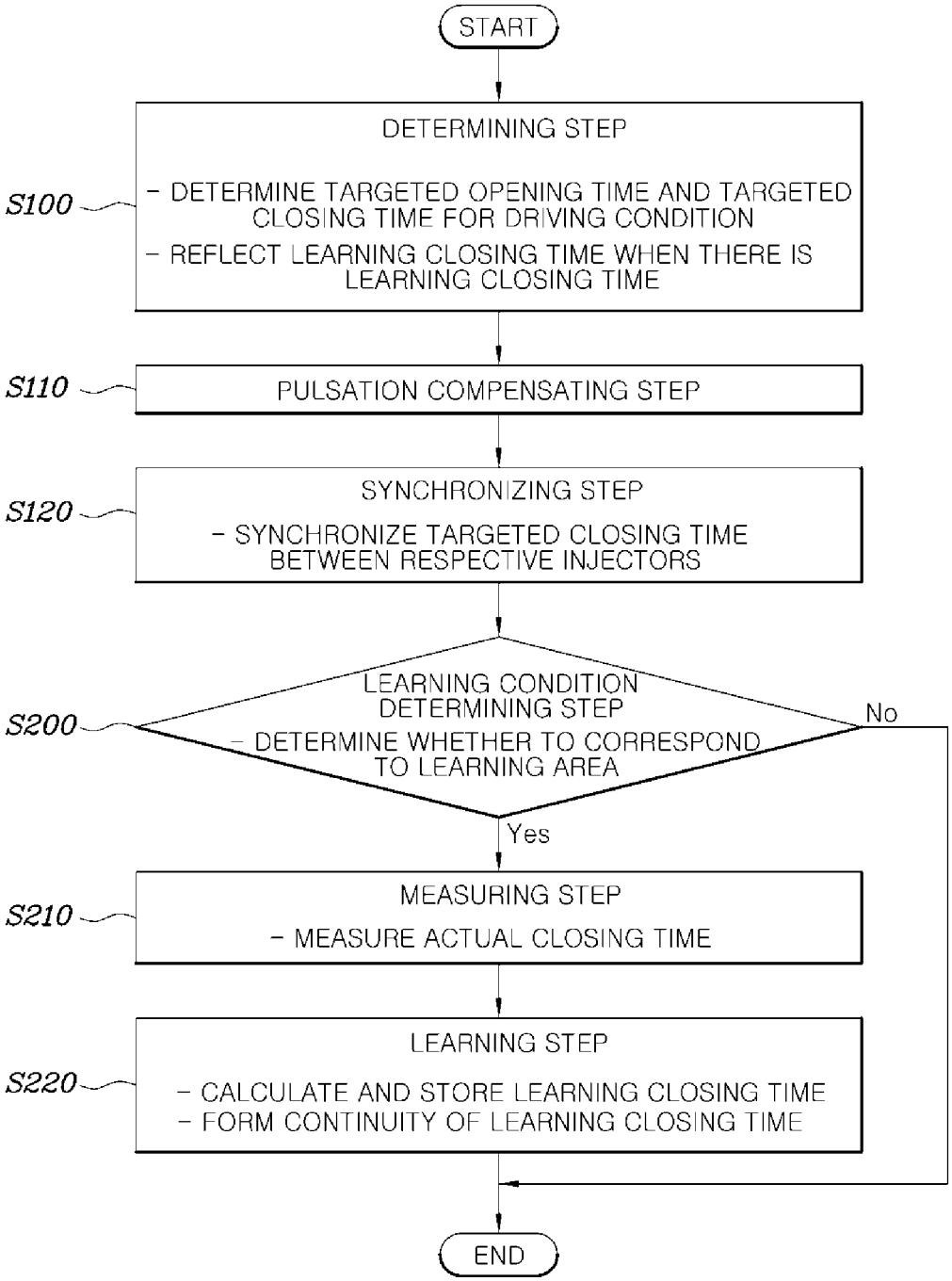
FIG. 1 is a flow chart illustrating a method for controlling an injector of a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be determined in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

As illustrated in FIG. 1 to FIG. 3, FIG. 10 and FIG. 11, a method for controlling an injector of a vehicle according to an exemplary embodiment of the present invention includes a step (S100) of determining, by a controller 150, a targeted opening time and a targeted closing time for at least one injector 110 according to a current driving condition; a step (S210) of measuring, by the controller, an actual closing time of the injector 110 controlled depending on the targeted closing time; and after the measuring step (S210), a learning step (S220) of determining, by the controller 150, a deviation of the actual closing time with respect to the targeted closing time and determining a learning closing time obtained by reflecting the deviation to the targeted closing time to store the corresponding driving condition, wherein in the determining step (S100), when there is the learning closing time stored for the current driving condition, the targeted closing time is determined by reflecting the learning closing time.

The above steps will be described below in detail. In the determining step (S100), the controller 150 determines the targeted opening time and the targeted closing time for at least one of the injectors 110 according to the current driving condition.

The controller 150 may correspond to an engine control unit (ECU) provided to control an engine 10 or the like, and may be provided separately from the ECU for controlling the injector 110.

The controller 150 may variously determine an fuel amount to be injected and an injection method by the injector 110 depending on a driving state of the vehicle in an exemplary embodiment of the present invention, the opening time for injecting fuel by the injector 110 and the closing time for closing an fuel injection of the injector 110 are determined according to the driving condition.

The opening time and the closing time form a one-time fuel injection process in a combustion cycle of the engine 10. A total time that may be spent in the fuel injection process will be determined by the combustion cycle of the engine 10, but may be increased or decreased by a certain amount depending on the determination of the opening time and the closing time, when necessary.

In an exemplary embodiment of the present invention, the closing time may be divided into the targeted closing time, the actual closing time, and a learning closing time. The closing time corresponds to a period in which the injector 110 is closed during a fuel injection cycle depending on the current requirements, and the targeted closing time corresponds to a theoretical value on which the injector 110 is required to be closed.

However, the targeted closing time may be determined by reflecting not only theoretical determinations but also experimental or statistical results. The actual closing time and the learning closing time will be described below.

The driving condition of the present invention may be various. the RPM of the engine 10, an intake air temperature, an oil temperature, an accelerator pedal engagement amount, a fuel amount, a fuel pressure, an intake pressure, and the like may be included, and when either the targeted opening time or the targeted closing time is determined, the determined value may be treated as the driving condition for the other determination.

Preferably, in an exemplary embodiment of the present invention, the driving condition may include the fuel amount and the fuel pressure (injection pressure) currently required, and the targeted closing time or the targeted opening time is used as a determination condition (driving condition for determining the corresponding value) with respect to each other.

As the driving condition, a method for determining a targeted opening time or a targeted closing time may be various. According to the exemplary embodiment of the present invention, it is possible to determine the fuel amount to be injected in consideration of the current RPM of the engine 10 or the like, and determine the targeted opening time or the targeted closing time in correlation to the fuel amount and the fuel pressure.

However, the fuel amount and the fuel pressure are elements exemplarily selected to help the description of the present invention, and the targeted opening time and the targeted closing time may be determined by replacing the elements with other elements.

Figure 2:
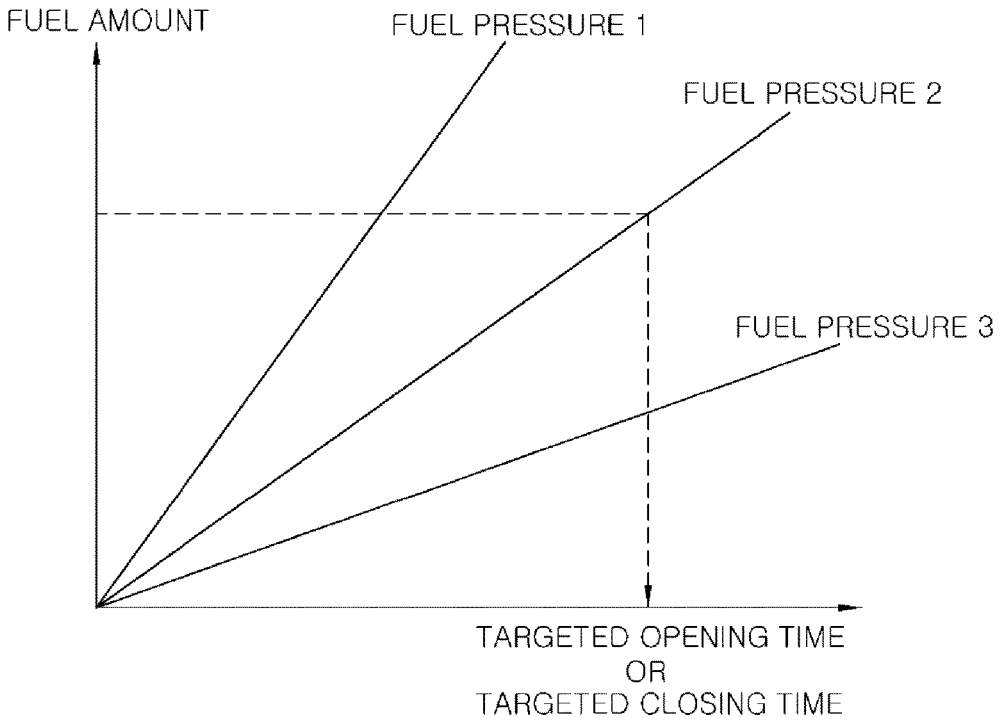
FIG. 2 is a graph schematically illustrating a correlation between a driving condition and a targeted opening time or a targeted closing time in the method for controlling an injector of a vehicle according to the exemplary embodiment of the present invention.

FIG. 2 illustrates a schematic graph in which the targeted opening time or the targeted closing time may be determined in the correlation between the fuel amount and fuel pressure currently required. The graph illustrated in FIG. 2 is stored in the controller 150 in advance, and the controller 150 may determine the current targeted opening time and the targeted closing time by substituting the current driving condition into the graph (or data map).

However, in the exemplary embodiment of the present invention, the targeted closing time may be determined first, the targeted opening time may also be determined in the correlation with the targeted closing time, or the targeted closing time may be determined by reflecting the previously learned learning closing time, which will be described below.

Although the driving conditions are set forth based on the fuel amount and the fuel pressure to help the understanding of the exemplary embodiment of the present invention, the driving conditions may include or be replaced with other factors in the equivalent relation.

Meanwhile, in the measuring step (S210), the controller 150 measures the actual closing time of the injector 110 controlled according to the targeted closing time.

The injector 110 is controlled by the targeted opening time and the targeted closing time determined in the determining step (S100). At the present point, the controller 150 actually measures the actual closing time controlled in the state in which the injector 110 is closed.

In the present case, the method for measuring the actual closing time may be various, and in the exemplary embodiment, the actual closing time may be understood by changing a current value or a voltage value generated by the injector 110. A detailed description according to the exemplary embodiment as described above will be described below.

In an exemplary embodiment of the present invention, to control the injector 110, the closing time is an important factor. Therefore, after controlling the injector 110 according to the targeted closing time determined in the determining step (S100), the controller 150 determines the time when the injector 110 is actually closed as the actual closing time through the measuring step (S210).

Meanwhile, in the learning step (S220), after the measuring step (S210), the controller 150 determines the deviation of the actual closing time with respect to the targeted closing time, and determines the learning closing time obtained by reflecting the deviation to the targeted closing time, storing the corresponding driving condition.

The injector 110 that injects fuel to the engine 10 rotating at high speed is very rapidly switched to the open or closed states. Accordingly, even when the operation depending on the actual control value is instructed, a delay may occur in response thereto, and the response result of the control of the injector 110 may be changed due to hardware or environmental factors.

Accordingly, the actual closing time of the injector 110 controlled with the targeted closing time is measured in the determining step and in the learning step (S220), the deviation is determined from the actual closing time and the targeted closing time and the deviation is reflected to correct the targeted closing time.

The targeted closing time corrected by reflecting the deviation is defined as the learning closing time in an exemplary embodiment of the present invention. When the learning closing time is derived, the controller 150 stores the corresponding driving condition and reflects the stored driving condition for the subsequent control.

A feedback control for the actual behavior of the injector 110 as described above may be made by considering the closing time. For example, in the injector 110 that injects fuel by applying the injection signal, the state in which an electrical signal for controlling the injector 110 in an open state is applied means the state in which the injector 110 is controlled in the completely open state.

The controller 150 recognizes the state in which the electrical signal is blocked as the closed state of the injector 110, but actually includes a process of shifting the state in which the injector 110 is closed. Strictly speaking, the injector 110 may include the state in which the fuel injection is being performed.

That is, there is a limit in hardware to understand whether the injector 110 corresponds to the state in which the fuel injection is actually closed in the control of the injector 110 using a signal indicating that the injector 110 corresponds to the targeted opening time or the open state of the injector 110 in the open state in the control of the injector 110.

Therefore, the present invention determines not only the opening time of the injector 110 but also the closing time during which the injector 110 needs to be closed, and performs the feedback control by analyzing how accurately the actual closing time follows the targeted closing time.

Since the engine 10 corresponds to a high speed rotating body and the fuel injection cycle of the injector 110 is very fast, an actually controlled minute error from the control targeted of the injector 110 may have a large effect on the control of the engine 10, or the like.

For example, when the actual closing time of the injector 110 differs from the targeted closing time, a fuel amount different from the currently required fuel amount will be introduced into the combustion chamber, which may cause a misfire of the engine 10 or increase harmful substances during the exhaust.

The above situation has a large effect on the control of the engine 10 as the injection timing of the injector 110 is precisely controlled, which becomes an obstacle in performing the precise control of the injector 110.

Accordingly, the present invention sets the closing time as the control element and determines the learning closing time so that the actual closing time may follow the targeted closing time, performing the precise control of the injector 110.

Meanwhile, in the determining step (S100), when there is the learning closing time stored for the current driving condition, the targeted closing time is determined by reflecting the learning closing time.

As described above, the controller 150 determines the targeted closing time and the targeted opening time for the current driving condition. When there is the learning closing time previously stored for the corresponding driving condition, the targeted closing time for the current injection cycle is determined by reflecting the learning closing time.

The method for reflecting the learning closing time may be various. For example, the targeted closing time may also be determined by use of the value averaged by measuring the learning closing time plural times, and the detailed current targeted closing time may also be determined by comparing the targeted closing time determined without considering the learning closing time for the current driving condition with the learning closing time.

When there is the learning closing time corrected by reflecting the actual closing time, the controller 150 may determine the stored learning closing time as the targeted closing time in the current driving condition.

By the above process, the present invention follows the control behavior that the injector 110 targets with high reliability and may perform the precise control depending on the targeted fuel amount, greatly improving the combustion efficiency of the engine 10.

FIG. 1 illustrates a control sequence of the present invention and FIG. 2 illustrates a graph in which the targeted opening time or the targeted closing time is set depending on the driving condition. Using the graph (data map), the controller 150 may determine the targeted opening time or the targeted closing time.

Figure 3:
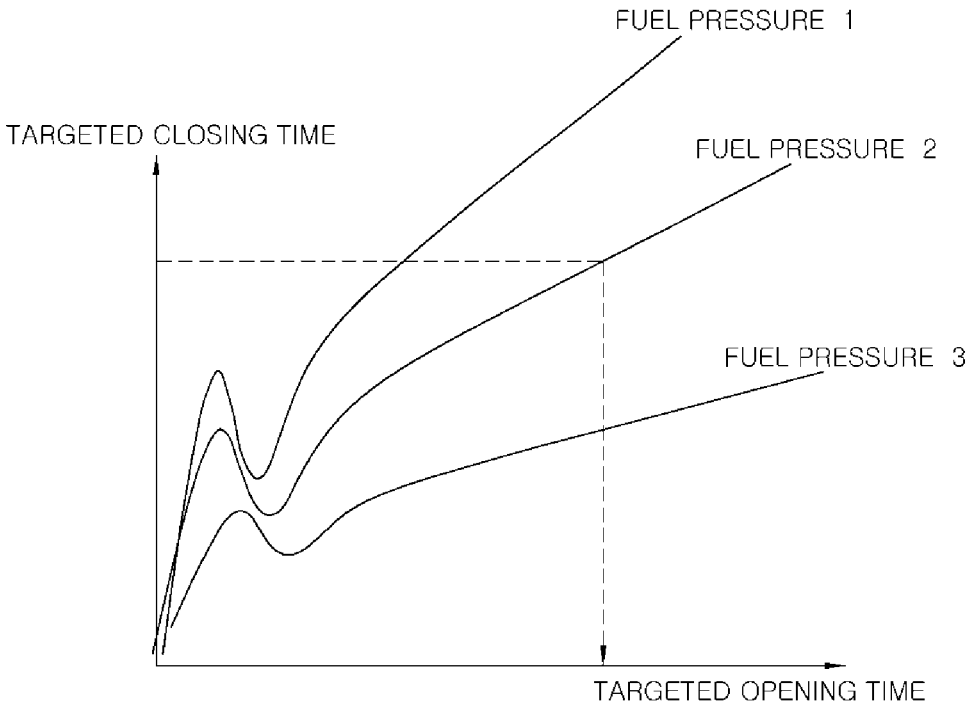
FIG. 3 is a graph schematically illustrating the correlation between the targeted opening time and the targeted closing time in the method for controlling an injector of a vehicle according to the exemplary embodiment of the present invention.

FIG. 3 illustrates a graph in which the correlation between the targeted opening time and the targeted closing time by the fuel pressure is preset. When the targeted opening time and the targeted closing time correspond to the determination conditions for each other, the graph as described above may be used.

For example, when the learning closing time is determined as the targeted closing time in the case where the learning closing time exists, the targeted opening time may also be determined by use of the predetermined targeted closing time as a variable.

Further, the correlation between the targeted opening time and the targeted closing time may be determined by adding various variables in terms of a control strategy. In the present case, it is important to utilize the graph (data map) in which the correlation between the targeted opening time and the targeted closing time is set as illustrated in FIG. 3.

Figure 10:
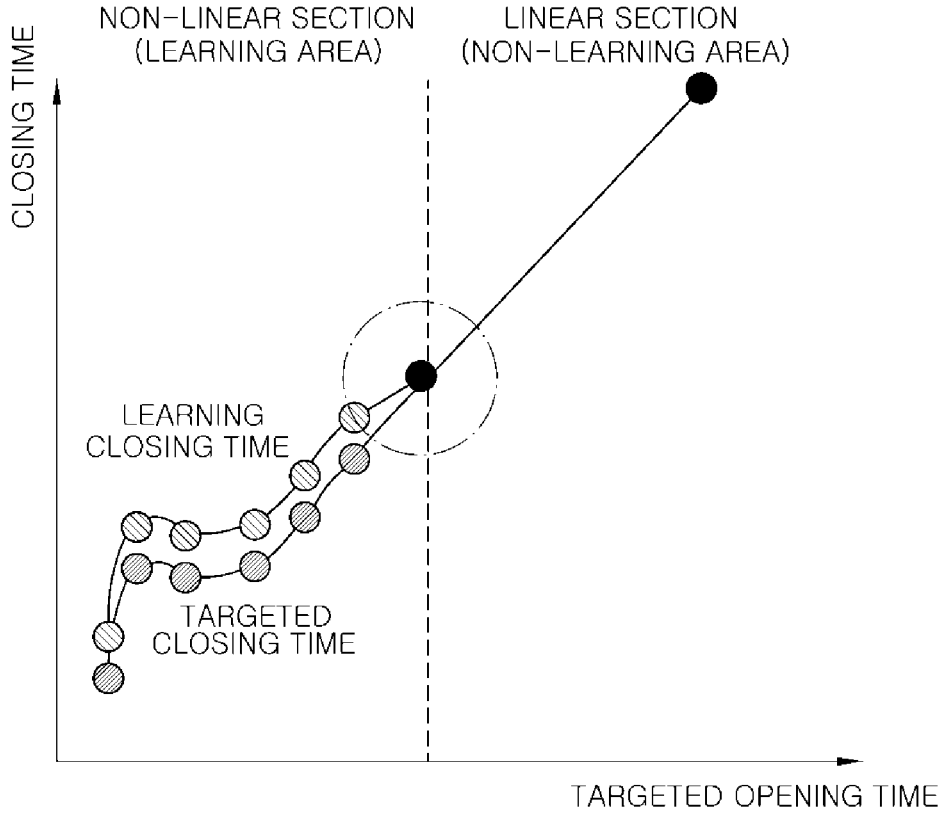
FIG. 10 is a graph illustrating the learning closing time set to form the continuity for the boundary condition of the learning area in the method for controlling an injector of a vehicle according to the exemplary embodiment of the present invention.

Meanwhile, FIG. 10 is a graph illustrating the targeted closing time and the learning closing time is obtained by reflecting the actual closing time to the targeted closing time (the graph illustrates the change in the closing time with respect to the opening time under the same fuel pressure condition).

As can be appreciated from FIG. 10, the learning closing time of the injector 110 to meet the actual targeted fuel amount is determined to be different from the targeted closing time, and the present invention uses the learning closing time to meet the targeted fuel amount and accurately controls the open state of the injector 110.

Meanwhile, as illustrated in FIG. 2, according to the method for controlling an injector of a vehicle according to the exemplary embodiment of the present invention, in the determining step (S100), the controller 150 may determine the targeted opening time and the targeted closing time, including the currently required fuel amount and fuel pressure in the driving condition.

As described above, according to an exemplary embodiment of the present invention, the driving condition may include various factors. According to the exemplary embodiment of the present invention, the targeted opening time and the targeted closing time are determined, including the fuel amount and the fuel pressure as the driving condition.

The fuel amount may be determined based on the current RPM of the engine 10 and accelerator pedal engagement amount, or the like. The determination of the fuel amount may include various other factors as variables, which are determined in terms of a control strategy.

Further, the current fuel pressure also determines a unit flow rate of fuel injected from the injector 110. That is, the targeted opening time and the targeted closing time of the injector 110 that are currently required may be determined based on the correlation between the fuel pressure and the fuel amount.

In addition to the above-mentioned important determination correlations, various elements are reflected by various methods in consideration of other control strategies to determine the targeted opening time and targeted closing time. FIG. 2 illustrates a graph (data map) in which the targeted opening time or the targeted closing time are predetermined based on the fuel amount and the fuel pressure as the driving condition.

Meanwhile, according to the method for controlling an injector of a vehicle according to the exemplary embodiment of the present invention, the fuel amount corresponds to a value corrected by reflecting an oil temperature. Since the fuel amount to be input into the actual combustion chamber may be changed depending on the oil temperature, according to the exemplary embodiment of the present invention, the targeted opening time or the targeted closing time is determined by use of the fuel amount corrected according to the oil temperature.

Figure 4:
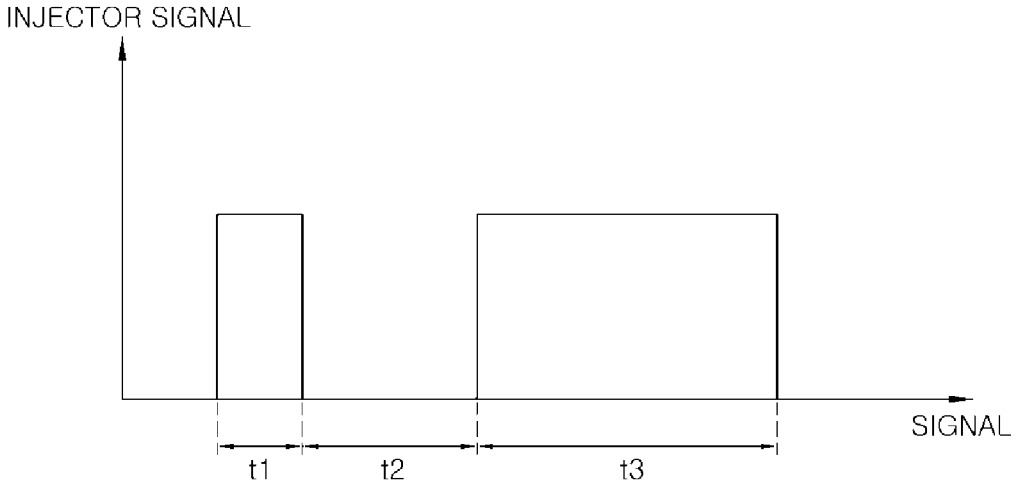
FIG. 4 is a graph illustrating an appearance in which the targeted opening time of the injector is determined in a multi stage in the method for controlling an injector of a vehicle according to the exemplary embodiment of the present invention.

Meanwhile, as illustrated in FIG. 3 and FIG. 4, according to the method for controlling an injector of a vehicle according to the exemplary embodiment of the present invention, in the determining step (S100), the controller 150 determines the targeted closing time according to the driving condition and determines the targeted opening time by reflecting the targeted closing time.

As described above, the closing time of the injector 110 plays an important role in controlling the injector 110 according to an exemplary embodiment of the present invention. Therefore, according to the exemplary embodiment of the present invention, the targeted closing time is first determined according to the driving condition and the targeted opening time is determined by reflecting the targeted closing time.

According to an exemplary embodiment of the present invention, when there is the learning closing time for the corresponding driving condition, the learning closing time may be determined as the current targeted closing time. In the present case, the targeted opening time may be derived from the correlation between the targeted closing time and the fuel pressure.

The targeted opening time and the targeted closing time may be understood as a portion for the one-time fuel injection cycle. That is, when the targeted closing time of the cycle is determined as the section, the targeted opening time may be determined for other sections. Accordingly, the timing at which the fuel starts to be injected on the cycle may be determined differently.

Further, when the targeted closing time is determined, the progress time of the cycle may be adjusted accordingly. According to an embodiment, when the targeted closing time is quantitatively increased as a result of the learning, the progress time of the cycle may be increased to meet the targeted opening time quantitatively. Since the correlation between the targeted closing time and the targeted opening time may be learned as a result of reflecting various causes, the above-described results may be derived.

FIG. 3 illustrates a graph in which the correlation between the targeted opening time and the targeted closing time is determined. The graph of FIG. 3 is an exemplary embodiment, and it can be understood that the correlation is determined under the same fuel pressure, and the learning closing time is reflected.

FIG. 4 is a graph illustrating the results of setting the targeted opening time and the targeted closing time in the fuel injection cycle of the injector 110. In the graph, a horizontal axis represents a time axis, and a vertical axis represents an operation applying signal of the injector 110, which may be understood as values of 0 and 1.

Referring to FIG. 4, it can be understood that the fuel injection of the injector 110 is not performed at the same time as the cycle starts, which is related to the setting of the targeted closing time. In another exemplary embodiment, the targeted opening time itself may be determined to the corresponding portion according to the driving condition.

Meanwhile, as illustrated in FIG. 4, according to the method for controlling an injector of a vehicle according to the exemplary embodiment of the present invention, in the determining step (S100), the controller 150 determines the targeted opening time immediately before and after the targeted closing time, wherein the injection of the fuel by the injector 110 is performed in multi-stage.

The present invention is advantageous in performing precise control of the injector 110. That is, when there is a need to finely adjust the opening time and the closing time, it is possible to perform the fuel injection that satisfies the current driving situation while suppressing the misfire of the engine 10 or the increase of the harmful substances.

The above characteristics are advantageous in performing the multi-stage injection in which the fuel injection occurs a plurality of times in the one-time fuel injection cycle. When the multi-stage injection is performed, the control time of the injector 110 becomes shorter according to the opening time, and the precise control of the fuel injection of the injector 110 is required.

In the multi-step injection performance as described above, the exemplary embodiment of the present invention sets the targeted closing time between the plurality of targeted opening times when the fuel injection is required, and controls the injector 110 accordingly, accurately and precisely controlling the injector 110.

FIG. 4 is a graph illustrating the targeted opening time and the targeted closing time for multi-stage injection as described above. In the graph of FIG. 4, t1 and t3 each correspond to the targeted opening time.

The t2 is the targeted closing time set between the plurality of targeted opening times. As can be appreciated from FIG. 4, since there is the second targeted opening time t2 within a comparatively rapid time period after the first targeted opening time t1, when the control of the injector 110 is not precisely performed at the first targeted opening time, the fuel injection control may be greatly affected when the performance of the second targeted opening time is considered.

As described above, the performance of the multi-stage injection is more likely to cause the misfire of the engine 10 than the single injection situation. The exemplary embodiment of the present invention may directly understand the closed state of the injector 110 between the plurality of targeted opening times and control the injector 110, performing the precise multi-stage injection in the multi-stage injection.

Meanwhile, as illustrated in FIG. 1, the method for controlling an injector of a vehicle according to the exemplary embodiment of the present invention may further include a pulsation compensating step (S110) of compensating for, by the controller 150, the targeted closing time by considering the influence of a pulsation according to the RPM of the engine after the determining step (S100).

In the engine 10 circulating at a high speed in the combustion cycle, a vibration may be generated based on the pressure according to the RPM. The pulsation vibration due to the repetitive change in pressure may affect the injector 110 in which the fuel injection cycle is progressed depending on the engine RPM.

Accordingly, according to the exemplary embodiment of the present invention, the influence of the pulsation is determined on the basis of the current RPM of the engine and the injector 110 is controlled by compensating for the targeted closing time for the effect. The compensation method may be various.

For example, the data map in which the compensation value of the pulsation determined theoretically or experimentally for the current fuel pressure and the RPM of the engine is predetermined is stored in the controller 150, and the controller 150 may use the method for determining the current compensation value by substituting the RPM of the engine and the fuel pressure as the current driving condition into the predetermined data map.

Accordingly, the exemplary embodiment of the present invention may control the injector 110 based on the targeted closing time whose influence of the pulsation is corrected, and improve the reliability and precision for the precise control of the injector 110.

Figure 5:
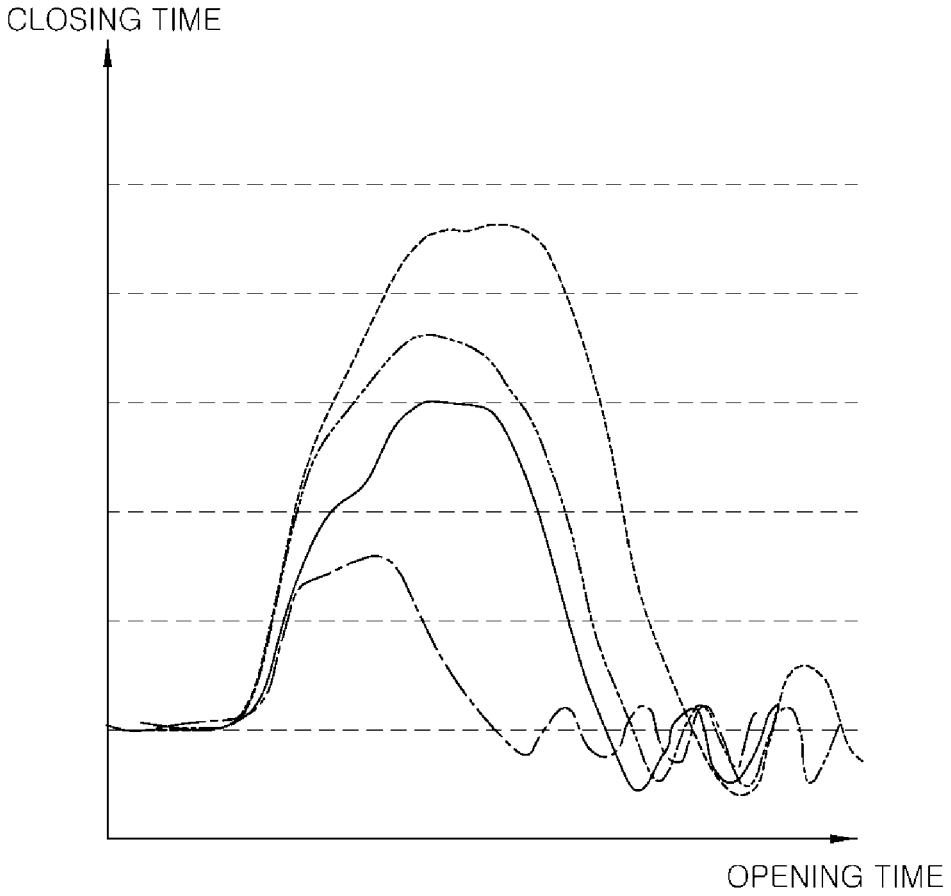
FIG. 5 is a graph schematically illustrating the targeted closing time before the plurality of injectors is synchronized in the method for controlling an injector of a vehicle according to the exemplary embodiment of the present invention.
Figure 6:
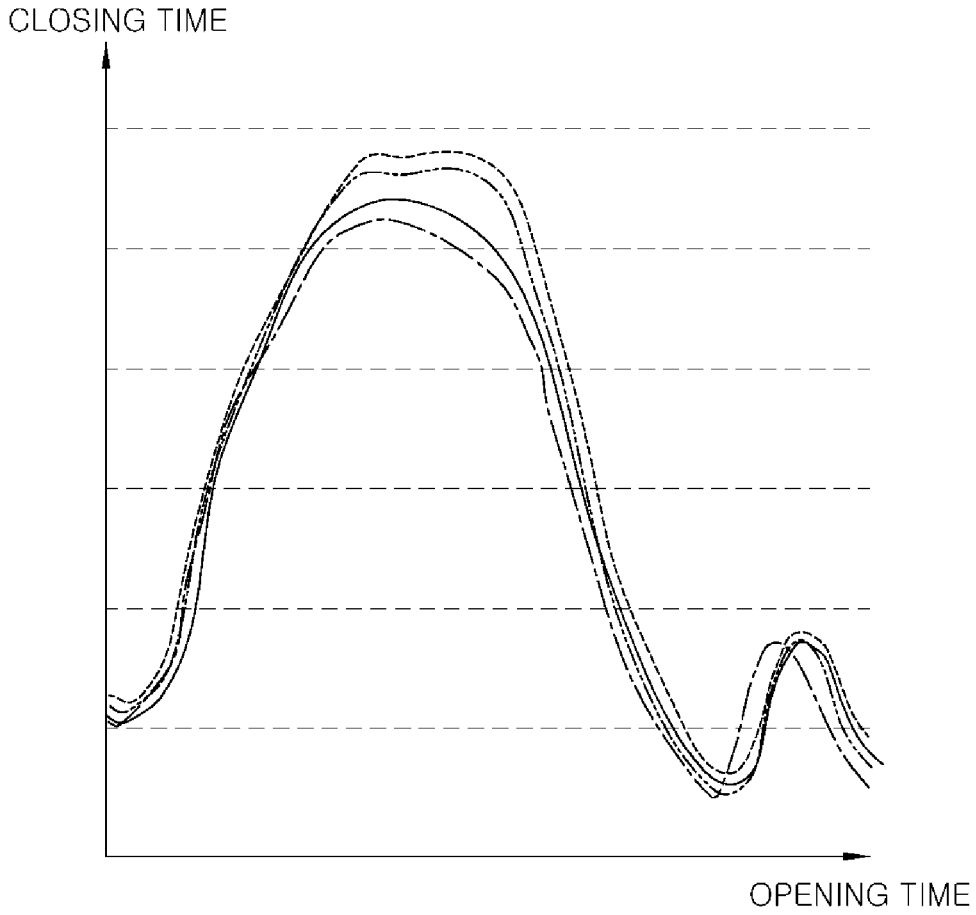
FIG. 6 is a graph schematically illustrating the targeted closing time in the state in which the plurality of injectors is synchronized in the method for controlling an injector of a vehicle according to the exemplary embodiment of the present invention.

Meanwhile, as illustrated in FIG. 5 and FIG. 6, the method for controlling an injector of a vehicle according to the exemplary embodiment of the present invention may further include a step (S120) of synchronizing, by the controller 150, the targeted closing times between the plurality of injectors 110 after the determining step (S100).

According to the exemplary embodiment of the present invention, the feedback control may not be only performed using the closing time of the injector 110, but the closing times between the plurality of injectors 110 are also synchronized in a state where the plurality of injectors 110 are provided to reduce the difference between the combustion situation occurring in the plurality of combustion chambers, stably controlling the engine 10.

When a plurality of injectors 110 are provided, the controller 150 may determine different targeted closing times from the results of each injector 110. For example, different learning closing times may be stored due to the minute hardware difference between the injectors 110.

According to the exemplary embodiment of the present invention, for the plurality of targeted closing times determined for the plurality of injectors 110, a synchronization process therebetween is performed, and thus the closing time matching rate of the entire injectors 110 may be improved, wherein the combustion process performed between the plurality of combustion chambers may suppress the situation that different results are shown.

For example, when the amounts of fuel introduced into the respective combustion chambers are different from each other, the misfire of the engine 10 may occur in some of the combustion chambers, and explosive forces therebetween may be different from each other to cause vibration on the rotation speed of the output shaft of the engine 10.

The exemplary embodiment of the present invention synchronizes a plurality of targeted closing times as described above to overcome the difference of each injector 110 and to perform the stable control of the engine 10 as a whole.

The synchronization according to the exemplary embodiment of the present invention as described above may be understood as the matched rate of the valve lift. When the synchronization, according to the exemplary embodiment of the present invention, is performed, the valve lifts of the respective injectors 110 are synchronized with each other and thus the engine 10 may be stably controlled.

FIG. 5 is a graph illustrating the targeted closing time before the synchronization between the injectors 110 is progressed. Referring to FIG. 5, it can be confirmed that the targeted closing times of the respective injectors 110 with respect to the targeted opening time shows a somewhat large deviation.

Meanwhile, FIG. 6 is a graph illustrating the state in which the targeted closing times between the respective injectors 110 are synchronized according to the exemplary embodiment of the present invention. As can be confirmed from FIG. 6, it may be confirmed that the deviation between the targeted closing times of the respective injectors 110 with respect to the targeted opening time is significantly reduced as compared with the graph of FIG. 5.

Figure 7:
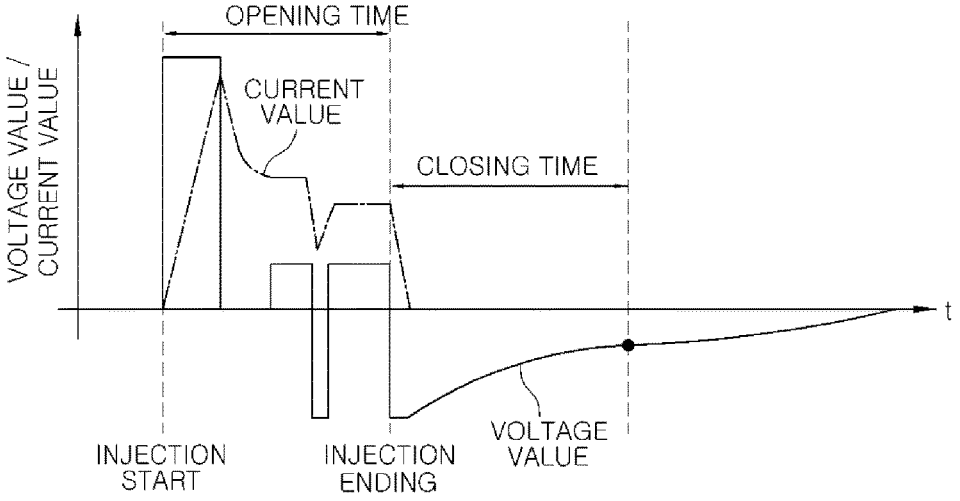
FIG. 7 is a graph illustrating a voltage value depending on an operation state of the injector in the method for controlling an injector of a vehicle according to the exemplary embodiment of the present invention.
Figure 11:
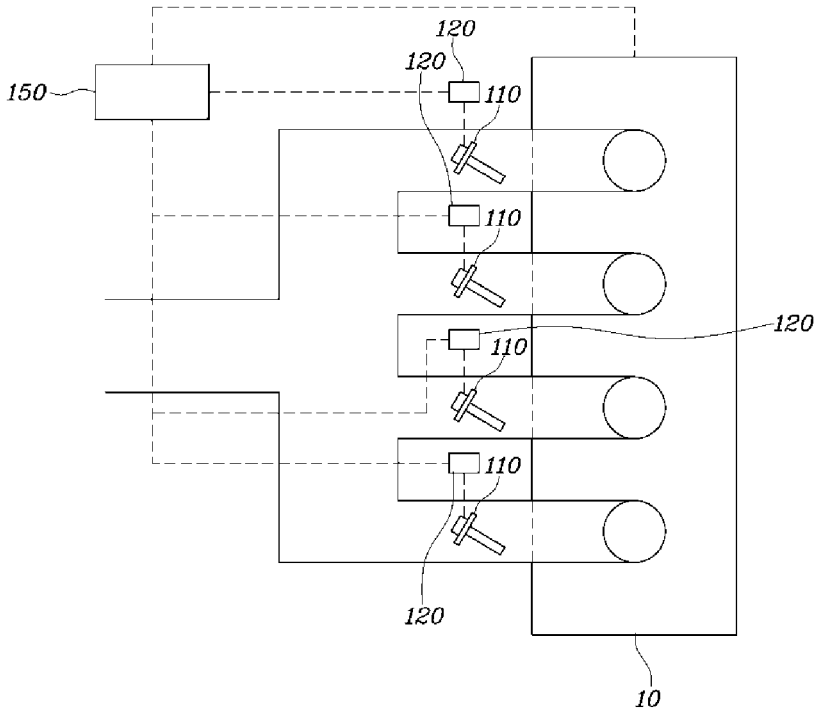
FIG. 11 is a diagram schematically illustrating a system for controlling an injector of a vehicle according to an exemplary embodiment of the present invention.

Meanwhile, as illustrated in FIG. 7 and FIG. 11, in the method for controlling an injector of a vehicle according to the exemplary embodiment of the present invention, in the measuring step (S210), a voltage detecting device 120 measures the voltage value for the operation of the injector 110, and the controller 150 receives the voltage value and determines the actual closing time.

As described above, there is a limitation of determining the closing state using the signal for the opening state of the injector 110. Accordingly, another method for measuring the actual closing time is required. In the exemplary embodiment of the present invention, the actual closing time is determined using the voltage value measured from the injector 110.

FIG. 7 illustrates the change in the current value and the voltage value of the injector 110 according to the opening or closing control of the injector 110. To control the injector 110 to be open, the corresponding current value is applied to the injector 110.

Referring to FIG. 7, the current value applied to the injector 110 for controlling the injector 110 to be in the open state is illustrated. The injector 110 is in the open state while the current value starts to be applied for the opening the injector 110.

Meanwhile, to switch the injector 110 controlled in the open state to the closed state, the current value applied to the injector 110 disappears. At the present point, the timing when the current value starts to be reduced corresponds to the termination of the targeted opening time of the injector 110. As can be seen from FIG. 7, the current value does not disappear at a time and therefore a delay time occurs. Further, the current value does not exist in the closed state of the injector 110, and therefore the current value is inadequate for measuring the actual closing time.

On the other hand, referring to the voltage value of FIG. 7, it may be seen that the injector 110 is controlled to be in the closed state when the voltage value is a negative value. That is, in terms of hardware, it is possible to measure the actual closing time of the injector 110 by changing the voltage value occurring according to the closing control of the injector 110.

According to the exemplary embodiment of the present invention, the voltage detecting device 120 for measuring the voltage value for the injector 110 is provided to measure the actual closing time of the injector 110 in hardware, and the controller 150 analyzes the voltage value on the injector 110 measured by the voltage detecting device 120 to measure the actual closing time of the injector 110. The voltage detecting device 120 may be a driver for applying the current value and the voltage value to the injector 110 (or an actuator).

FIG. 11 schematically illustrates the exemplary embodiment of the present invention. The plurality of injectors 110 are provided and the voltage detecting devices 120 each are provided for measuring the voltage value of the injector 110. The controller 120 that receives a voltage value signal from the voltage detecting device 120 and analyzes the received voltage value is illustrated.

Figure 8:
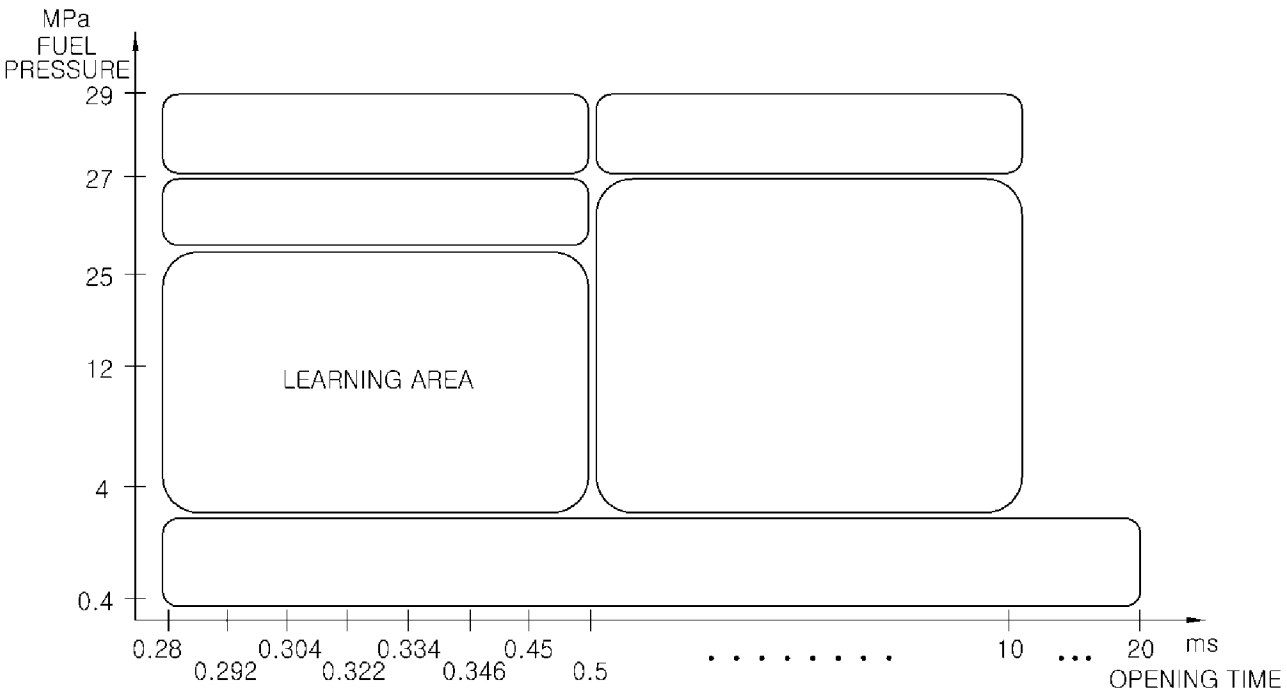
FIG. 8 is a graph schematically illustrating a learning area in which a learning closing time is stored in a method for controlling an injector of a vehicle according to the exemplary embodiment of the present invention.

Meanwhile, as illustrated in FIG. 1 and FIG. 8, the method for controlling an injector of a vehicle according to an exemplary embodiment of the present invention further includes a learning condition determining step (S200) of determining, by the controller 150, whether the driving condition corresponds to a predetermined learning area after the determining step (S100), and in the measuring step (S210), the actual closing time is measured when the driving condition corresponds to the learning area.

In the exemplary embodiment of the present invention, the controller 150 previously sets the learning area in which the learning closing time to is configured to be learned according to the driving conditions.

The setting of the learning area may be performed by various methods. As the exemplary embodiment, there is the driving area in which the targeted closing time is changed while having a large deviation, in response to the change in the driving condition. In the case of the driving area, the change in the targeted closing time is increased in response to the change in the driving condition, and therefore the level at which the precise control of the injector 100 is required is increased.

On the contrary, there is the area in which the targeted closing time has a relatively linear change in the driving area other than the learning area, wherein there is a case in which a separate closing time learning is unnecessary.

Accordingly, in the exemplary embodiment of the present invention, the driving area in which the closing time is non-linearly changed in response to the change in the driving condition is set as the learning area, and the learning closing time for the corresponding area is stored.

The driving condition for distinguishing the learning area may be variously determined, and may be preferably set for the fuel pressure, the fuel amount, or the targeted opening time. The targeted opening time may be substituted into the fuel amount on the same fuel pressure, and is one of the driving conditions that may be adopted for the setting of the learning area.

FIG. 8 is a graph illustrating the situation where the learning area is set according to the driving condition. The present graph relates to the exemplary embodiment, in which the horizontal axis represents the targeted opening time of the injector 110 and the vertical axis represents the fuel pressure. It is needless to say that the learning area of FIG. 7 may also be set as the area other than the area illustrated in FIG. 7 in consideration of various causes.

As a result, in the exemplary embodiment of the present invention, the driving area in which the non-linear behavior in response to the change of the driving condition is shown and the targeted closing time is changed is designated as the learning area to store the learning closing time for the learning area, effectively performing the learning process for the closing time of the injector 110 to improve the effectiveness.

Figure 9:
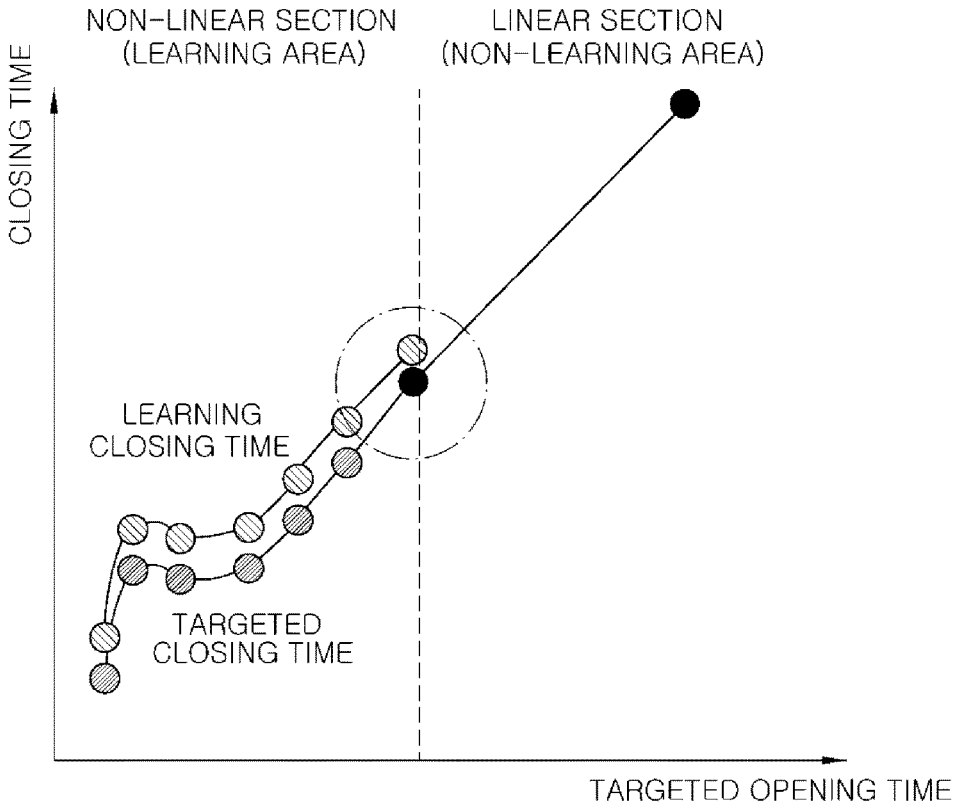
FIG. 9 is a graph illustrating the learning closing time of the learning area prior to forming continuity for a boundary condition of the learning area in the method for controlling an injector of a vehicle according to the exemplary embodiment of the present invention.

Meanwhile, as illustrated in FIG. 9 and FIG. 10, in the method for controlling an injector of a vehicle according to the exemplary embodiment of the present invention, in the learning step (S220), the controller 150 determines the learning closing time to which the actual closing time is reflected in the learning area under at least one specific driving condition, and sets and stores the learning closing time for an area in which the specific driving condition is ruled out from the learning area so the learning closing time has the continuity in response to the change in the driving condition and follows the learning closing time determined in the specific driving condition.

In the exemplary embodiment of the present invention, the learning closing time of the injector 110 is set and stored by designating the learning area, and even the learning area has a realistic limitation of deriving the learning closing time for all the driving conditions.

Accordingly, in the exemplary embodiment of the present invention, the specific driving condition is selected in the learning area. The specific driving condition may be determined in various ways, and in the exemplary embodiment, considering that the targeted closing time of the learning area shows the non-linear behavior, and therefore the learning is required, the driving condition with non-linearity to the theoretical targeted closing time may be extracted, which may be determined as the specific driving condition.

When the actual closing time for the specific driving condition is measured and thus the learning closing time is set and stored, the learning closing time for the driving area between the specific driving conditions is changed having continuity and thus a value is set and stored to reach the learning closing portion between the specific driving conditions.

FIG. 9 and FIG. 10 are graphs (data map) in which the learning closing time is determined and stored by measuring the actual closing portion for the specific operating condition and the learning closing time shows a continuous value in response to the change in the driving condition from the learning closing time on any one of the specific driving conditions in the driving area between the specific driving conditions, and is set to follow the learning closing time on another specific driving condition.

In the graphs of FIG. 9 and FIG. 10, the horizontal axis represents the targeted opening time and the vertical axis represents the learning closing time or the targeted closing time (the vertical axis in the area out of the learning area represents the targeted closing time).

The data lines represented on the graphs FIG. 9 and FIG. 10 are set for a constant fuel pressure. That is, the targeted opening time of the horizontal axis may be switched even to the fuel amount and the targeted opening time is used to explicitly indicate the non-linear change portion and the linear change portion of the closing time for the change in the driving condition.

Looking at the learning area, the learning closing time derived by measuring the actual closing time is represented by dots on the data line. The appearance in which the driving condition at the position indicated by the point corresponds to the specific driving condition, and the learning closing time is set to be changed while having continuity in a portion between the points may be confirmed.

Accordingly, in the exemplary embodiment of the present invention, it is possible to efficiently set the closing time by the learning and stably control the injector 110 by preventing the sudden change in the targeted closing time (the learning closing time becomes the targeted closing time) caused by the change in the driving condition by the rational continuity setting.

Meanwhile, as illustrated in FIG. 9 and FIG. 10, in the method for controlling an injector of a vehicle according to the exemplary embodiment of the present invention, in the learning step (S220), the controller 150 sets and stores the learning closing time stored in the learning area so that the learning closing time follows the targeted closing time for the boundary condition of the learning area while having continuity in response to the change in the driving condition.

In the driving area depending on the driving condition, the boundary condition is formed between the learning area and other driving areas. In FIG. 9 and FIG. 10, a boundary line between the learning area and the non-learning area corresponds to the boundary condition.

The learning area is set to perform the learning depending on the actual closing time and form the continuity of the learning closing portion data value between the respective specific driving conditions. However, the targeted closing time determined as the theoretical or experimental statistics is set in the non-learning area in which the above-mentioned learning is not performed, and therefore the difference between the learning closing time set in the learning area and the targeted closing time occurs in the boundary condition between the learning area and the non-learning area.

Accordingly, in the exemplary embodiment of the present invention, the learning closing time of the learning area has the continuity in response to the change of the driving condition, and is set and stored to follow the targeted closing time in the boundary condition.

FIG. 9 shows a graph (data map) in which the continuity for the boundary condition is not formed, and FIG. 10 shows a graph (data map) in which the continuity for the boundary condition is formed.

Comparing FIG. 9 and FIG. 10, it may be confirmed that the data line for the learning closing time in the boundary condition is changed. That is, in the case of FIG. 9, the learning closing time and the targeted closing time are different from each other in the boundary condition, but in the case of FIG. 10, it may be confirmed that the learning closing time coincides with the targeted closing time in the boundary condition.

In FIG. 10, in the exemplary embodiment of the present invention, the targeted closing time in the boundary condition is treated as the learning closing time in the specific driving condition, and it may be confirmed that the learning closing time is set to have the continuously changed value from the learning closing time in the adjacent specific driving conditions on the driving area and follow the target closing time under the boundary condition.

In the graphs of FIG. 9 and FIG. 10, the vertical axis is set as the targeted opening time, but the result of forming the continuity according to the exemplary embodiment of the present invention is not to be significantly different even when the vertical axis variable is changed to the fuel amount or the fuel pressure As a result, in the exemplary embodiment of the present invention, the targeted closing time (reflecting the learning closing time) not only has the continuity in response to the change of the driving condition in the learning area, but the targeted closing time is also changed continuously even in the boundary condition out of the learning area, wherein the control of the injector 110 using the targeted closing time becomes stable and efficient.

According to the method for controlling an injector of a vehicle as described above, it is possible to effectively improve the engine performance, the fuel efficiency, and effectively reduce the harmful substances by precisely controlling the fuel injection in the injector of the vehicle that injects fuel.

The present invention may use the closing time of the injector besides the opening time of the injector in the control of the injector to enable the accurate feedback for the control of the injector, facilitating the precise control of the fuel injection.

In addition, it is possible to perform the stable and high-reliability injector control by determining the targeted closing time with respect to the closing time and using the learning closing time in consideration of the actual closing time according to the targeted closing time.

Meanwhile, it is possible to perform the stable injector control by synchronizing the closing time between the respective injectors when the plurality of injectors is provided, effectively preventing the occurrence of the misfire in some of the combustion chambers or the occurrence of the deviation between the combustion chambers.

Furthermore, it is possible to perform the efficient learning by designating the area in which the learning of the closing time in the driving condition is required as the learning area and establishing the continuity of the learning closing time and the targeted closing time, performing the effective fuel injection control.

For convenience in explanation and accurate definition in the appended claims, the terms "upper", "lower", "internal", "outer", "up", "down", "upwards", "downwards", "front", "rear", "back", "inside", "outside", "inwardly", "outwardly", "internal", "external", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the invention be defined by the Claims appended hereto and their equivalents.

What is claimed is:

1. A method for controlling a plurality of injectors of an engine of a vehicle, comprising:

a step of determining, by a controller, a targeted opening time and a targeted closing time for each of the plurality of injectors according to a current driving condition;

a step of measuring, by the controller, actual closing times of the injectors controlled depending on the targeted closing times;

after the measuring step, a learning step of calculating, by the controller, a deviation of the actual closing times with respect to the targeted closing times and calculating a learning closing time obtained by reflecting the deviation to the targeted closing times to store a corresponding driving condition; and a step of synchronizing, by the controller, the targeted closing times between the plurality of injectors after the determining step, wherein in the determining step, when there is the learning closing time stored for the current driving condition, the targeted closing times are determined by reflecting the learning closing time.

2. The method of claim 1, wherein in the determining step, the controller is configured to determine the targeted opening times and the targeted closing times, by including a currently required fuel amount and fuel pressure in the current driving condition.

3. The method of claim 2, wherein in the determining step, the currently required fuel amount corresponds to a value corrected by reflecting an oil temperature.

4. The method of claim 1, wherein in the determining step, the controller is configured to determine the targeted closing times according to the current driving condition and is configured to determine the targeted opening times by reflecting the targeted closing times.

5. The method of claim 1, wherein in the determining step, the controller is configured to determine the targeted opening before and after the targeted closing times, wherein injection of fuel by the injectors is performed in multi stages.

6. The method of claim 1, further including:

a pulsation compensating step of compensating for, by the controller, the targeted closing times by considering an influence of pulsation according to revolution per minute (RPM) of the engine after the determining step.

7. The method of claim 1, wherein in the measuring step, a voltage detecting device measures a voltage value for the operation of the injectors and the controller receives the voltage value and is configured to determine the actual closing times.

8. The method of claim 1, further including:

a learning condition determining step of determining, by the controller, whether the current driving condition corresponds to a predetermined learning area after the determining step, wherein in the measuring step, the actual closing times are measured when the current driving condition corresponds to the predetermined learning area.

9. The method of claim 8, wherein in the learning step, the controller is configured to determine the learning closing time to which the actual closing times are reflected in the predetermined learning area under at least one predetermined driving condition and is configured to set and to store the learning closing time for a predetermined area in which the at least one predetermined driving condition is ruled out from the predetermined learning area so the learning closing time has a continuity in response to a change in the at least one predetermined driving condition and follows the learning closing time determined in the at least one predetermined driving condition.

10. The method of claim 9, wherein in the learning step, the controller is configured to set and to store the learning closing time stored in the predetermined learning area wherein the learning closing time follows the targeted closing times for a boundary condition of the predetermined learning area while having the continuity in response to the change in the at least one predetermined driving condition.

* * * * *